US009386828B2

(12) United States Patent
Mardkha

(10) Patent No.: US 9,386,828 B2
(45) **Date of Patent: *Jul. 12, 2016**

(54) RING WITH OUTER MARKINGS/SEGMENTS FOR SETTING GEMSTONES

(71) Applicant: Joseph Mardkha, New York, NY (US)

(72) Inventor: Joseph Mardkha, New York, NY (US)

( * ) Notice: Subject to any disclaimer, the term of this patent is extended or adjusted under 35 U.S.C. 154(b) by 257 days.

This patent is subject to a terminal disclaimer.

(21) Appl. No.: 14/167,173

(22) Filed: Jan. 29, 2014

(65) Prior Publication Data

US 2014/0144601 A1 May 29, 2014

Related U.S. Application Data

(63) Continuation of application No. 13/313,431, filed on Dec. 7, 2011, now Pat. No. 8,677,624.

(51) Int. Cl.

| | |
|---|---|
| ***A44C 27/00*** | (2006.01) |
| ***A44C 9/00*** | (2006.01) |
| ***A44C 17/04*** | (2006.01) |
| *B21D 53/44* | (2006.01) |

(52) U.S. Cl.

CPC ..... *A44C 27/002* (2013.01); *A44C 9/00* (2013.01); *A44C 17/046* (2013.01); *A44C 27/00* (2013.01); *B21D 53/44* (2013.01); *Y10T 29/21* (2015.01); *Y10T 29/23* (2015.01); *Y10T 29/4978* (2015.01); *Y10T 29/49588* (2015.01); *Y10T 29/49593* (2015.01)

(58) Field of Classification Search

CPC ..... A44C 27/00; B21D 53/44; Y10T 29/49588–29/49597

USPC ..... 63/15–15.9, 28; 705/26.1

See application file for complete search history.

(56) References Cited

U.S. PATENT DOCUMENTS

| | | | |
|---|---|---|---|
| 802,267 | A | 10/1905 | Chaumet |
| 1,422,819 | A | 7/1922 | Blaicher |
| 1,428,158 | A | 9/1922 | Fuermann |
| D83,719 | S | 3/1931 | Burgess |
| 1,863,617 | A | 6/1932 | Brogan |
| D88,984 | S | 1/1933 | Peterson |
| D94,476 | S | 2/1935 | Granat |
| D136,698 | S | 11/1943 | Sacks |
| 2,610,385 | A | 9/1952 | Manne |
| D203,551 | S | 1/1966 | Tranfield |
| 3,321,934 | A | 5/1967 | Boyd |
| 4,821,533 | A | 4/1989 | Bonnefoy |
| 5,003,678 | A | 4/1991 | Oganesyan |
| D329,992 | S | 10/1992 | Dostourian |

(Continued)

FOREIGN PATENT DOCUMENTS

| | | | |
|---|---|---|---|
| JP | H07-39524 | U | 7/1995 |
| KR | 2011-0000039 | U | 1/2011 |

OTHER PUBLICATIONS

Notification of Transmittal of the International Search Report and the Written Opinino of the International Searching Authority, or the Declaration, issued for Internatonal Appl No. PCT/US2012/068239, mailing date Mar. 27, 2013.

(Continued)

*Primary Examiner* — Christopher Besler
(74) *Attorney, Agent, or Firm* — Blank Rome LLP

(57) ABSTRACT

A ring including a shank having platforms at predetermined locations on an outer surface of the shank, where the platforms identify preferred positions for setting gemstones.

9 Claims, 13 Drawing Sheets

(56) References Cited

U.S. PATENT DOCUMENTS

| | | | | |
|---|---|---|---|---|
| D345,815 | S | 4/1994 | Schonbek | |
| 5,339,655 | A | 8/1994 | Grando | |
| 5,592,835 | A | 1/1997 | Herr | |
| 5,765,398 | A | 6/1998 | Bardisbanyan | |
| 5,806,158 | A | 9/1998 | Wang | |
| 6,253,433 | B1 | 7/2001 | Barron | |
| 6,412,304 | B1 | 7/2002 | Adelman | |
| 6,450,402 | B1 | 9/2002 | Regev | |
| 6,484,536 | B1 | 11/2002 | Gould | |
| 6,851,278 | B2 | 2/2005 | Keenan | |
| 7,266,514 | B2 | 9/2007 | Herbert et al. | |
| 7,419,083 | B1 | 9/2008 | Cheng | |
| 7,693,751 | B2 | 4/2010 | Aronson | |
| 7,885,862 | B1 | 2/2011 | Vincent et al. | |
| 8,567,065 | B2 * | 10/2013 | Mardkha | A44C 9/00 29/401.1 |
| 8,677,624 | B2 * | 3/2014 | Mardkha | A44C 9/00 29/10 |
| 2002/0002842 | A1 | 1/2002 | Molfese | |
| 2002/0108397 | A1 | 8/2002 | Muller et al. | |
| 2005/0261989 | A1 | 11/2005 | Vadon et al. | |
| 2005/0288940 | A1 | 12/2005 | Cushman et al. | |
| 2007/0095105 | A1 | 5/2007 | Dagesian et al. | |
| 2007/0137250 | A1 | 6/2007 | Kohl | |
| 2007/0219960 | A1 | 9/2007 | Vadon et al. | |
| 2007/0250456 | A1 | 10/2007 | Braunwart | |
| 2008/0047299 | A1 * | 2/2008 | Baum | A44C 9/00 63/15.6 |
| 2008/0168800 | A1 | 7/2008 | Nisguretsky | |
| 2008/0197538 | A1 | 8/2008 | Miller | |
| 2008/0235925 | A1 | 10/2008 | Hoover et al. | |
| 2009/0071192 | A1 | 3/2009 | Bauman | |
| 2009/0144174 | A1 | 6/2009 | Reddy | |
| 2009/0299877 | A1 | 12/2009 | Vadon | |
| 2011/0302958 | A1 | 12/2011 | Mardkha | |
| 2012/0101830 | A1 | 4/2012 | Dholakiya | |

OTHER PUBLICATIONS

Mann, Mark; Mann Lainie, Lennon's Jewelers:How CAD/CAM Helped One Family Jeweler Boost Custom Design, Jun. 2006, Reed Exhibits Ltd. Jewelers Notebook, 316-317, 320-321.

* cited by examiner

RING WITH OUTER MARKINGS/SEGMENTS FOR SETTING GEMSTONES

CROSS REFERENCE TO RELATED APPLICATIONS

The present application is a continuation of application Ser. No. 13/313,431, filed Dec. 7, 2011, the entire contents of which are incorporated herein by reference.

BACKGROUND

This invention relates to a ring with markings for identifying positions for setting gemstones in the future and to a method for marking the ring for the purpose of setting such gemstones in the marked positions.

Jewelers and jewelry vendors may benefit from repeated visits from customers. Those who purchase or wear jewelry, especially jewelry celebrating an event such as a wedding, may enjoy commemorating each anniversary of the event by adding a gemstone at the end of each year of marriage. Therefore, it may be desirable to provide a ring with markings or segments identifying positions for setting such gemstones in the future so as the gemstones are set into the ring on each anniversary of the event, the gemstones will be properly sized and spaced. As time passes, the purchaser or wearer may return to the jeweler on the anniversary of such event to purchase and have a gemstone set in a predetermined and marked positions of the ring. Repeat visits to set such gemstones may also provide the jeweler with additional opportunities to sell other goods and services during such visits.

Adding gemstones to a ring without such markings or segments would require the jeweler to identify a location for the new gemstone, then drill the ring to accommodate the new gemstone. The jeweler could misjudge, miscalculate or otherwise lack the precision necessary to ensure that the new gemstone(s) would be correctly sized and spaced to accommodate all the gemstones that may be desirably placed in the ring in the future. Further, because these tasks would need to be repeated each time a gemstone was added to a ring, possibly over the course of many years, there is an increased likelihood that mistakes in sizing or spacing of the gemstones would result in an unattractive ring or there will be insufficient space to include all desired gemstones. Further still, because new gemstones may be added by different jewelers, quality and aesthetic sensibilities may vary from one jeweler to the next, with each jeweler doing things differently from the last. This would risk asymmetry in size, spacing, and location of new gemstones that could negatively affect the beauty of the ring. Therefore, to ensure the gemstones are sized and placed properly, it may be desirable to create a pattern for the gemstones, then mark the ring accordingly. Markings could take into account milestones, such as the wedding itself, and five, ten, twenty-five, and fifty year anniversaries, and provide for different gemstones, for example, different types, colors, sizes, and varieties, for such milestones.

When buying a traditional ring with gemstones already set in the outer surface of a band, a buyer selects a band and a gemstone size and provides a finger measurement. The jeweler or manufacturer then determines the number of gemstones of selected size that will fit in the selected band based on gemstone size and ring dimensions including size. However, in a ring where gemstones are added over time, the number of yearly milestones, and therefore the number of gemstones that may be set in the ring are known at the outset. In that case, the jeweler or manufacturer must determine the size and spacing of the gemstones based on the number of gemstones and optionally the ring dimensions including width and outer circumference. The jeweler or manufacturer may then mark the ring for setting gemstones in the future. Such determination of gemstone sizing and spacing may be complicated by the presence of gemstones of different sizes and shapes.

In a ring where gemstones are added over time, there may be marked positions that are not yet occupied by gemstones. Therefore, it may be desirable to have a ring and method for marking a ring that provides a technique for making the desired marks on an outer surface of a ring in a reliable, repeatable manner and for automating the process for production purposes across various ring sizes and types.

SUMMARY OF THE DISCLOSURE

A ring including a shank having platforms at predetermined locations on an outer surface of the shank, where the platforms identify preferred positions for setting gemstones.

DETAILED DESCRIPTION

Figure 1:
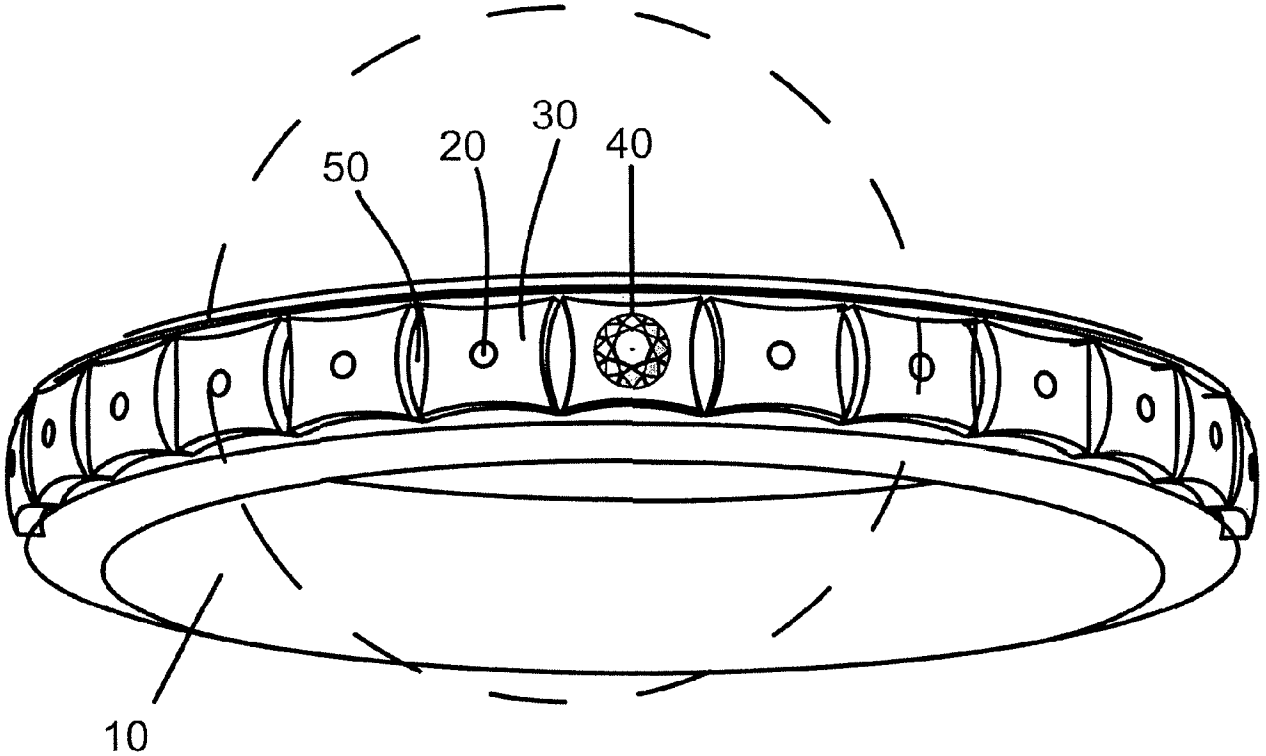
FIG. 1 shows a perspective view of a ring of the present disclosure.

The ring and method of the present disclosure may be described in detail using the accompanying drawings, wherein like reference numerals represent identical or corresponding parts throughout the several views. A ring and method for marking an inside surface of a shank is described in U.S. patent application Ser. No. 12/813,196 filed on Jun. 18, 2010, the contents of which is hereby incorporated by reference in its entirety.

The Ring

FIG. 1 shows ring 10 with markings 20 as indicators for future placement of gemstones on an outer surface of ring 10. In an aspect shown in FIG. 1, segments 30 may be formed by recessed region 50. Markings 20 may optionally be made on segments 30, and gemstones 40 may optionally be set in segments 30 based on location of markings 20. Ring 10 may be made of precious or non-precious material, including but not limited to platinum alloy, gold alloy, palladium alloy, silver alloy, or another alloy, and may be cast, die struck or machine created. Segments 30 may be formed by creating recessed region 50 around segments 30 by removing material and, in one non-limiting example, may be approximately 0.2 mm deep. Ring 10 may have a setting (not shown) to accommodate additional gemstones.

Figure 2:
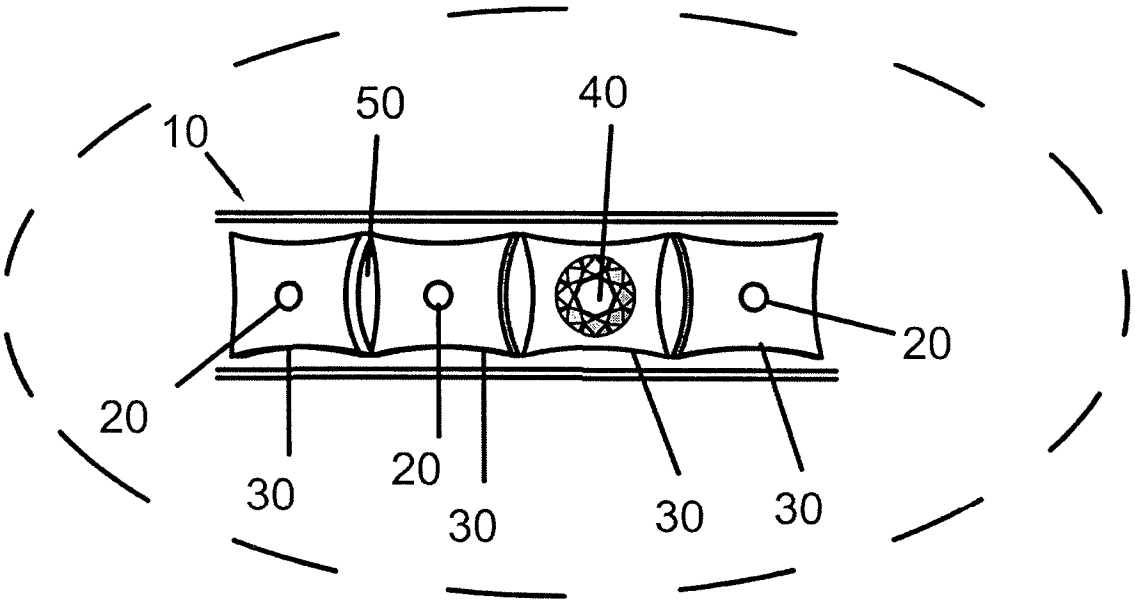
FIGS. 2, 2*a*, 2*b*, 2*c*, and 2*d* show close up views of a portion of an outer surface of a ring of the present disclosure.
Figure 2B:
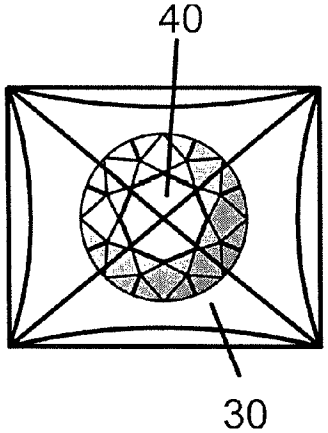
Figure 2A:
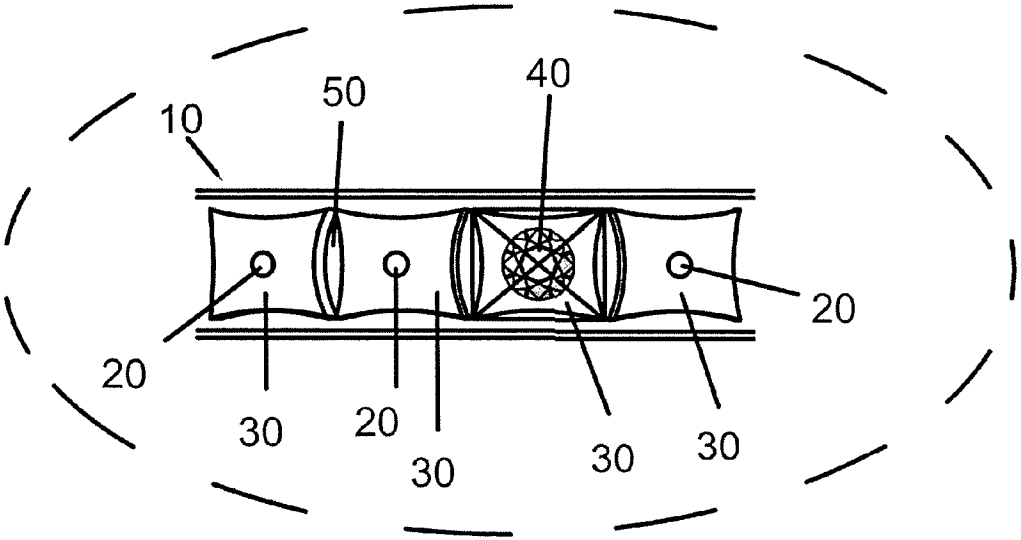
Figure 2D:
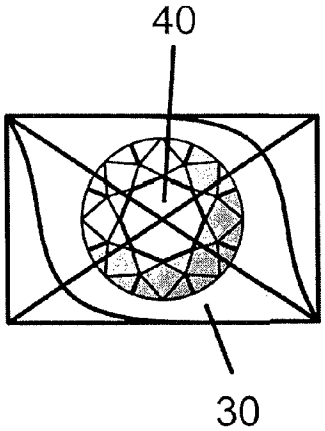
Figure 2C:
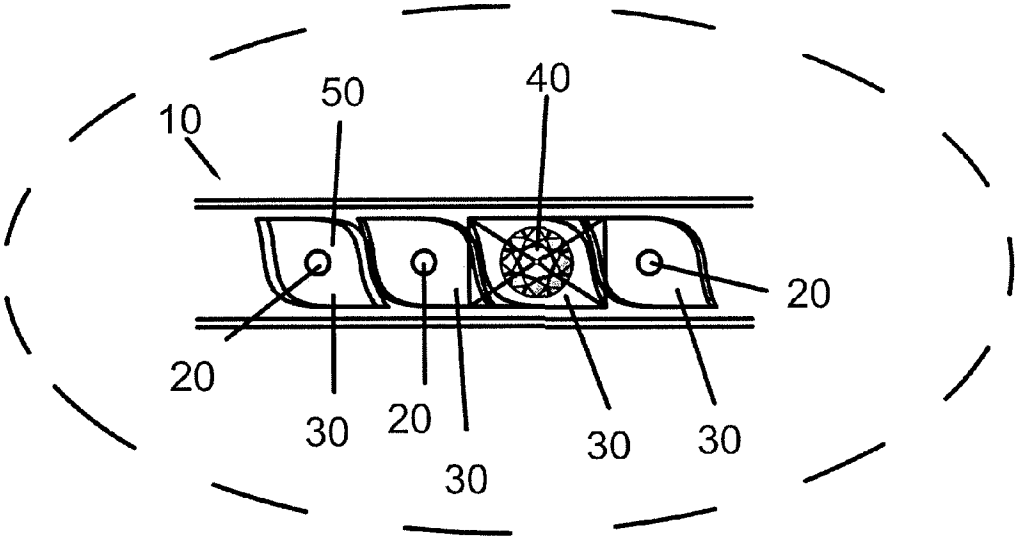

As shown in more detail in FIG. 2, markings 20 may identify the location of gemstones and may be a symbol, such as a square, circle, or other identifier. It will be understood that marking 20 may be other characters, symbols or graphics, such as a plus sign ("+") or asterisk ("*"). Marking 20 may be an indentation, engraving, scoring or raised portion. Markings 20 may be provided to identity to jewelers the location and optionally the size or type of gemstone that may occupy the location in the future. Markings 20 may be sized or otherwise indicate or correspond to sizes of gemstones to be set. FIG. 2 shows markings 20 that may identify a center point of placement of a gemstone. The distance between markings 20 to edge of segment 30 may be in one non-limiting example, approximately 0.2 mm.

Figure 3:
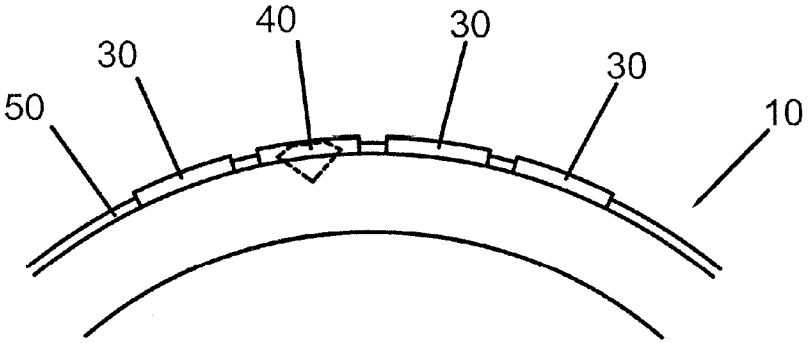
FIG. 3 shows a horizontal, cross-section view of a ring of the present disclosure.
Figure 4:
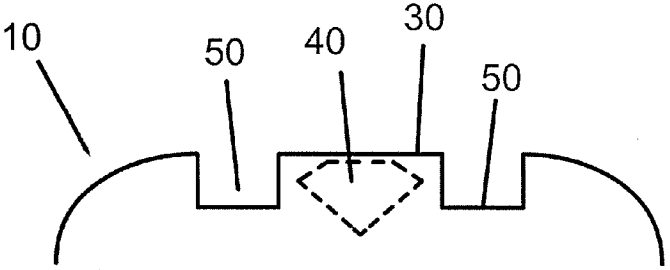
FIG. 4 shows a vertical, cross-section view of a ring of the present disclosure.

FIGS. 3 and 4 show horizontal and vertical cross-section views, respectively. In each of those figures, gemstone 40 is shown in dashed outline.

It will be understood that the number of gemstones in ring 10 may vary in number. In two non-limiting examples discussed in more detail, markings for 26 gemstones and 51 gemstones are shown. In those examples, a first gemstone may be set to commemorate a wedding day, and the remaining 25 or 50 gemstones may be set to commemorate yearly anniversaries for the following 25 or 50 years respectively. In one example, the first gemstone may be larger than the contemplated remaining gemstones.

Determining Marking Locations and Gemstone Size

Figure 5:
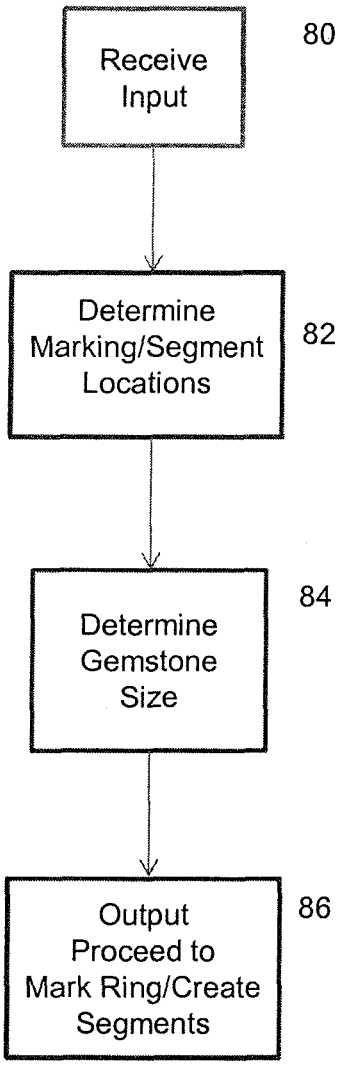
FIG. 5 shows a flowchart according to an aspect of the method of the present disclosure.

FIG. 5 shows a flowchart of a process for determining the locations of markings 20 (optional), the size and locations of segments 30, and the size of gemstones 40 that may be accommodated by ring 10. The dimensions of ring 10 and number of gemstones 40 to be inserted or markings 20 or segments 30 to appear on ring 10 are known and may be input by the user at Step 80.

At Step 82, the process determines the locations of markings 20 and/or segments 30. Markings 20 may serve as a center point for determining the locations of segments 30, even in cases where markings 20 are not shown on ring 10. In one aspect, markings 20 and/or segments 30 may be centered along a centerline bisecting ring 10 and equally spaced along the outer surface of ring 10. In that case, location of markings 20 may be identified by dividing 360 degrees by the number of markings 20 or segments 30, which in one non-limiting example may be 26 or 51. Marking 20 may identity the center of segment 30, and marking 20 may not be displayed on ring 10. This calculation will yield the degrees of spacing between each marking 20 or center point of segment 30. Segments 30 may be sized and arranged to accommodate marking 20 and/or gemstone 40, and may be of various shapes and styles, as determined by the user. Locations for markings 20 and/or segments may be placed along a center line bisecting ring 10.

Figure 8:
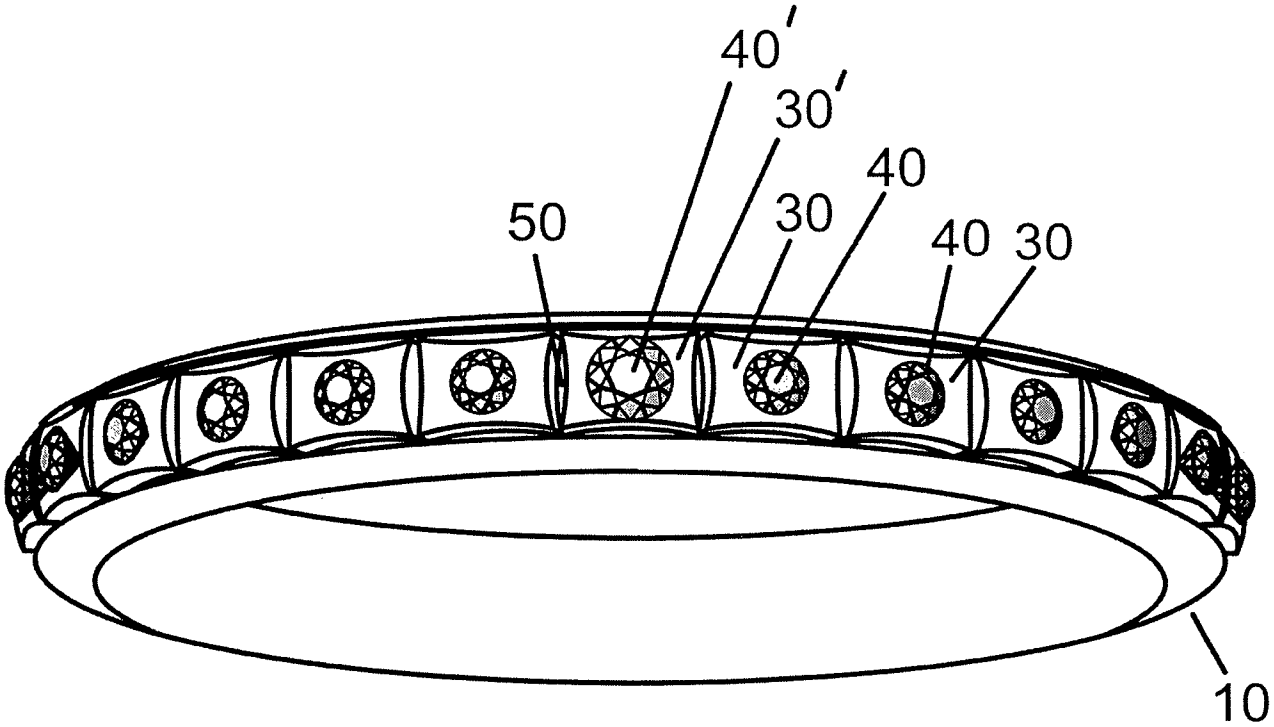

In another aspect shown in FIG. 8, one or more segment 30' and/or one or more corresponding gemstone 40' may be larger than the other segments 30 and gemstones 40. In one non-limiting example, the larger gemstone may be referred to as a primary gemstone 40' set in ring 10 and the corresponding primary segment 30' may include space for a setting (not shown). In this case, when determining the location of other secondary markings 20 or secondary segments 30, the larger size of the primary segment 30' may be taken into account. In such calculation, the span of primary segment 30' in degrees is subtracted from 360 degrees and that quantity divided by the number of secondary segments 30 plus one, to yield the spacing in degrees between the markings 20 or center points of segments 30 and the edge of primary segment 30'. In another non-limiting example where there are multiple primary gemstones 40' and primary segments 30' (not shown), the sizes of those larger gemstones and segments are taken into account. The quantity of primary segments 30' are multiplied by the size in degrees of each primary segment 30' and that number is subtracted from 360 degrees to create a first quantity. The remaining secondary segments 30 are then equally spaced between primary segments 30'.

In one aspect, these calculations may result in relative marking locations that may be applied to rings of various outer circumferences. In Step 84, the gemstone size is determined. The size of primary gemstone 40' is limited by width of ring 10 and/or size of primary segment 30'. The size of secondary gemstones 40 is limited by width of ring 10 and/or the size of the secondary segments 30.

In one aspect, the presence of markings 20 on ring 10 may be optionally not shown on ring 10, and location of segments 30 may serve as a guide to placement of gemstones 40. When no markings 20 are present, a jeweler may determine the location of gemstone 40 within segment 30. In one non-limiting example, gemstone 40 may be centered vertically with respect to the width of ring 10 and may be centered horizontally with respect to segment 30. To determine the center point for placement of gemstone 40, one may draw a rectangle or square around the segment 30, then draw first line from the upper left corner to the lower right comer. One may then draw a second line from the upper right corner to the lower left corner. The intersection of the first and second lines may indicate a center of segment 30 for placement of gemstone 40. Two, non-limiting examples of such center point determination for two segment 30 shapes are shown in FIGS. 2*a*, 2*b*, 2*c*, and 2*d*.

At Step 86, the process outputs the location of markings 20 and/or segments 30 that may be used to mark ring 10 as described below.

Ring Marking and Gemstone Setting

Figure 6:
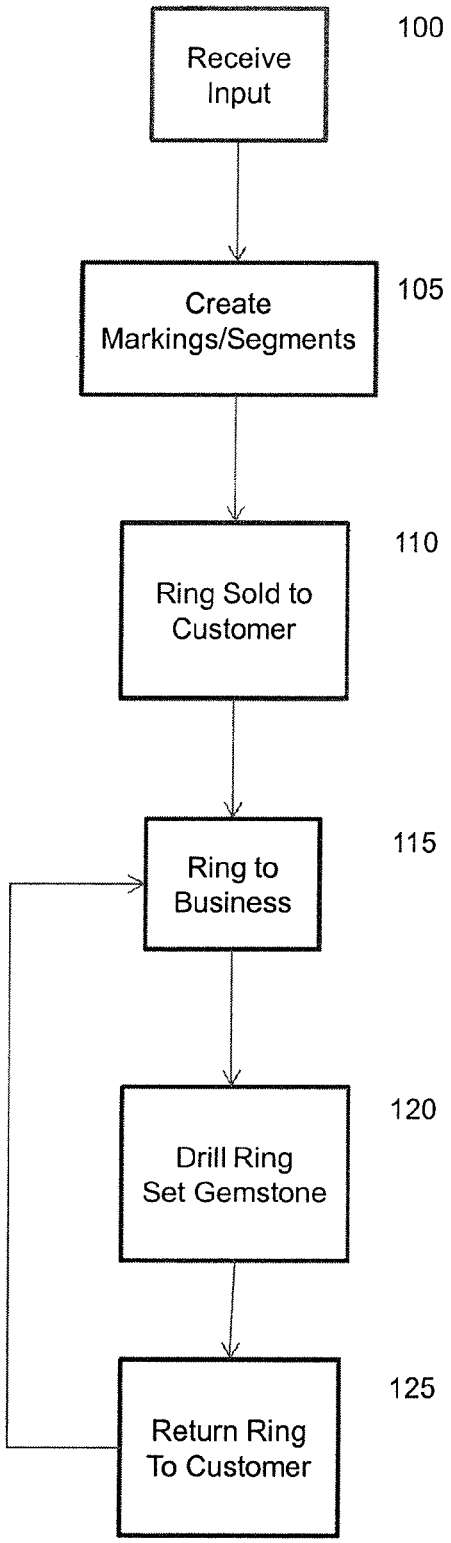
FIG. 6 shows a flowchart according to an aspect of the method of the present disclosure.

FIG. 6 is a flowchart of the process of marking and setting gemstones in ring 10. In Step 100, the process may receive as input one or more of the following: number of markings and/or segments, marking locations, marking types, marking sizes, segment sizes, segment locations, segment styles for a specific finger size into control software. In one aspect, software such as Visual LaserStar Write (VLW) or CAD 2v1.14 and any updates may be used control a laser engraving system such as a Crawford-LaserStar Technologies 20-watt Marking Laser, 3500 Series. In other aspects, markings 20 and segments 30 may be made by a machined engraving process, including but not limited to a CNC machine or may be created during the casting process. In Step 105, ring 10, which may be a plain band, may be inserted into the laser engraving system and the system may engrave the markings 20 and/or form segments 30 by creating recess 50 in ring 10. Optionally, gemstone 40 may be set into ring 10 using marking 20 to commemorate an initial event. In Step 110, the ring is sold to a customer. Sometime later, at Step 115, the customer may cause ring 10 to be sent to an authorized individual or business to set a gemstone in ring 10. At Step 120, a gem-setter or milling machine may drill a hole at one or more markings 20 or at the center point of segment 30 to accommodate a gemstone. The markings 20 or segments 30 may be used as a guide for drilling the hole size and location. A gemstone may then be set into the hole. At Step 125, ring 10 may be returned to the owner and the process beginning at Step 115 may be repeated upon the next event or anniversary.

Figure 7:
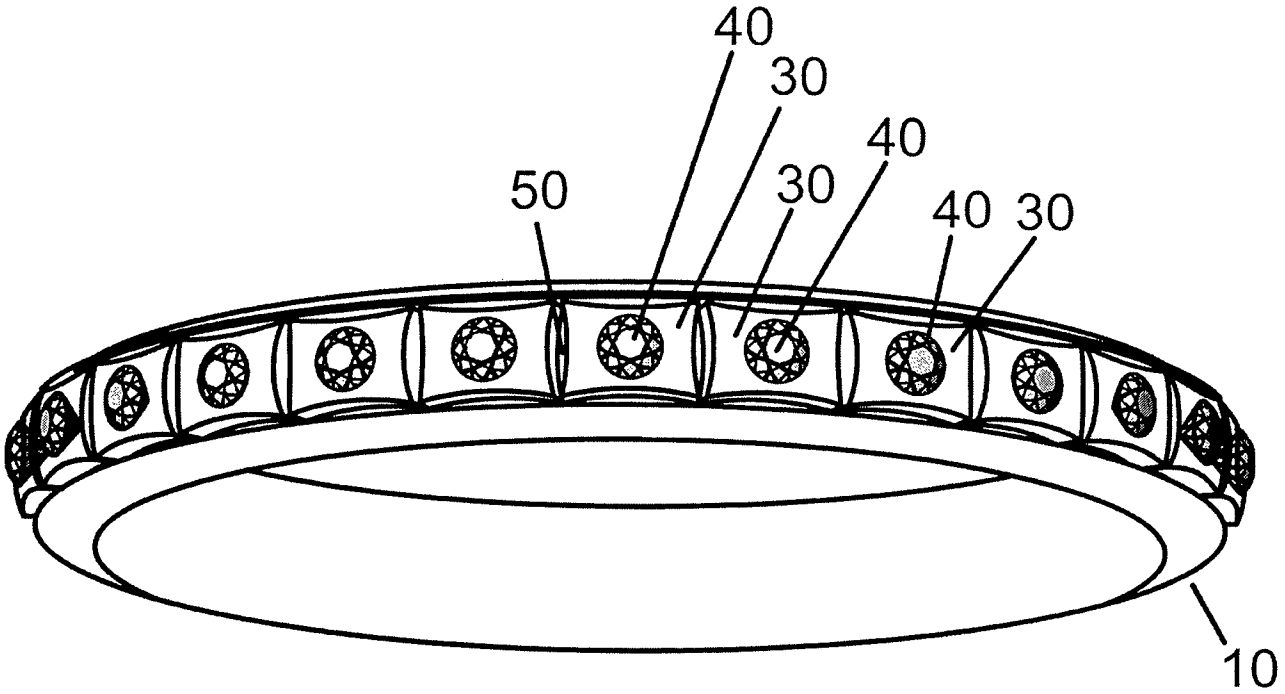
FIGS. 7 and 8 show rings with gemstones set according to the present disclosure.

FIG. 7 shows a ring with gemstones 40 of one size set in locations. FIG. 8 shows a ring with one larger primary gemstone 40' and other secondary gemstones 40 of smaller size set in locations.

Figure 9:
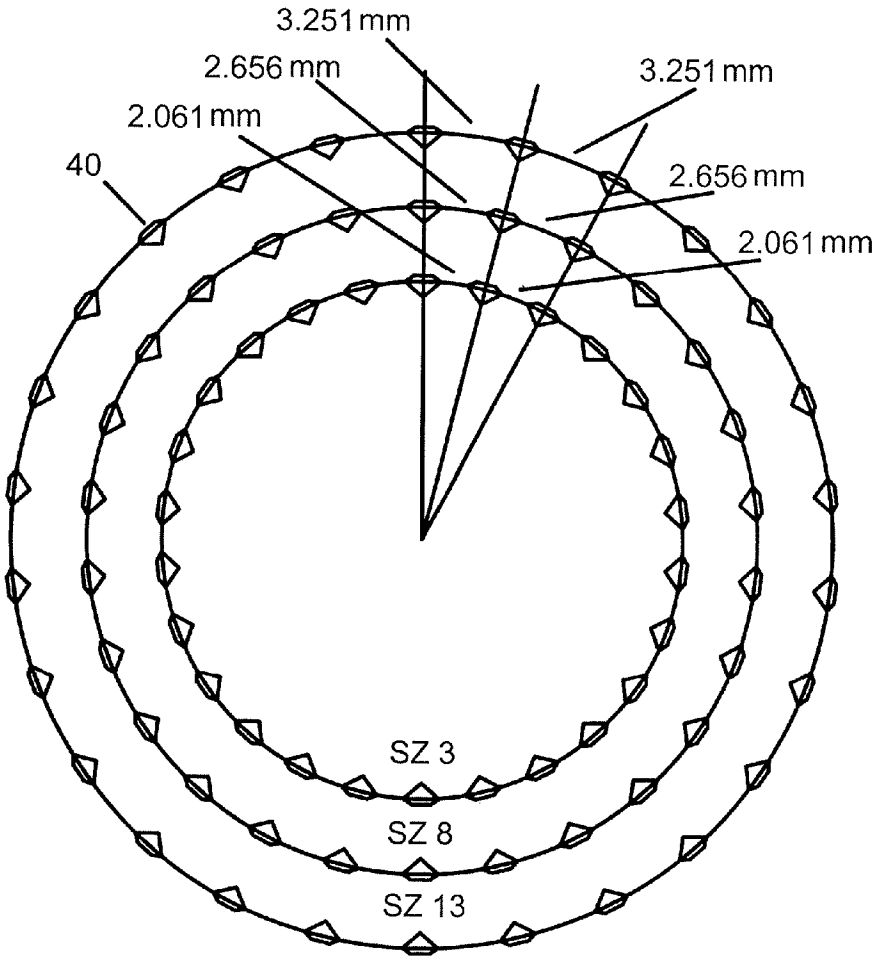
FIGS. 9-12 show gemstone spacing according to the present disclosure.
Figure 10:
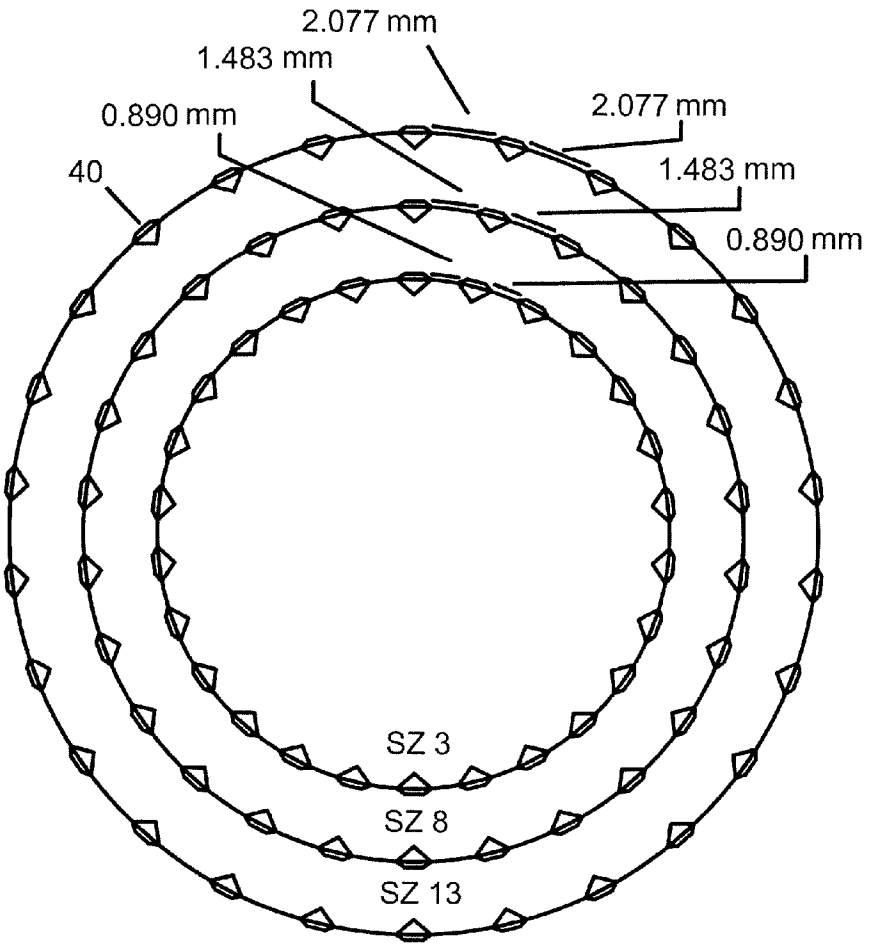

FIGS. 9-12 show spacing of gemstone 40 according to the present disclosure. FIGS. 9 and 10 show locations and spacing for 26 gemstones 40 of one size, for ring sizes 3, 8, and 13.

In FIG. 9, gemstones 40 are shown to be set 2.061 mm, 2.656 mm, and 3.251 mm apart measured from a center point of gemstone 40 for sizes 3, 8, and 13, respectively. In FIG. 10, gemstones 40 are shown to be set 0.890 mm, 1.483 mm, and 2.077 mm apart measured from edge to edge of gemstone 40 for sizes 3, 8, and 13, respectively.

Figure 11:
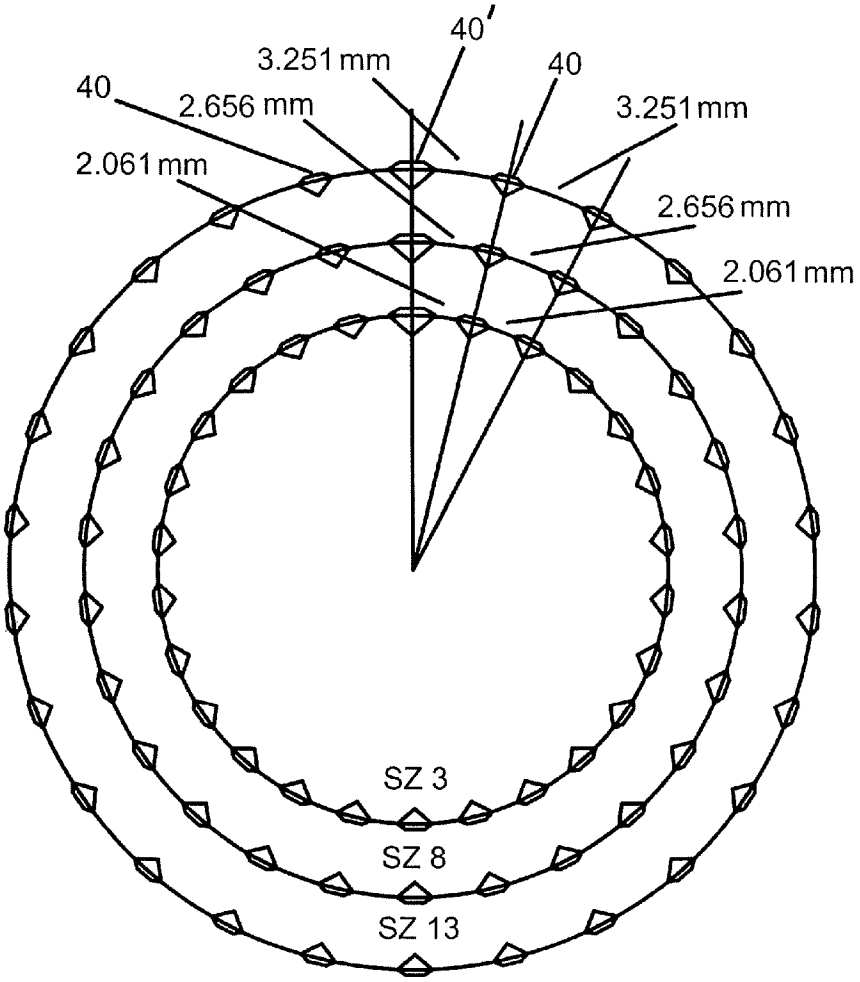
Figure 12:
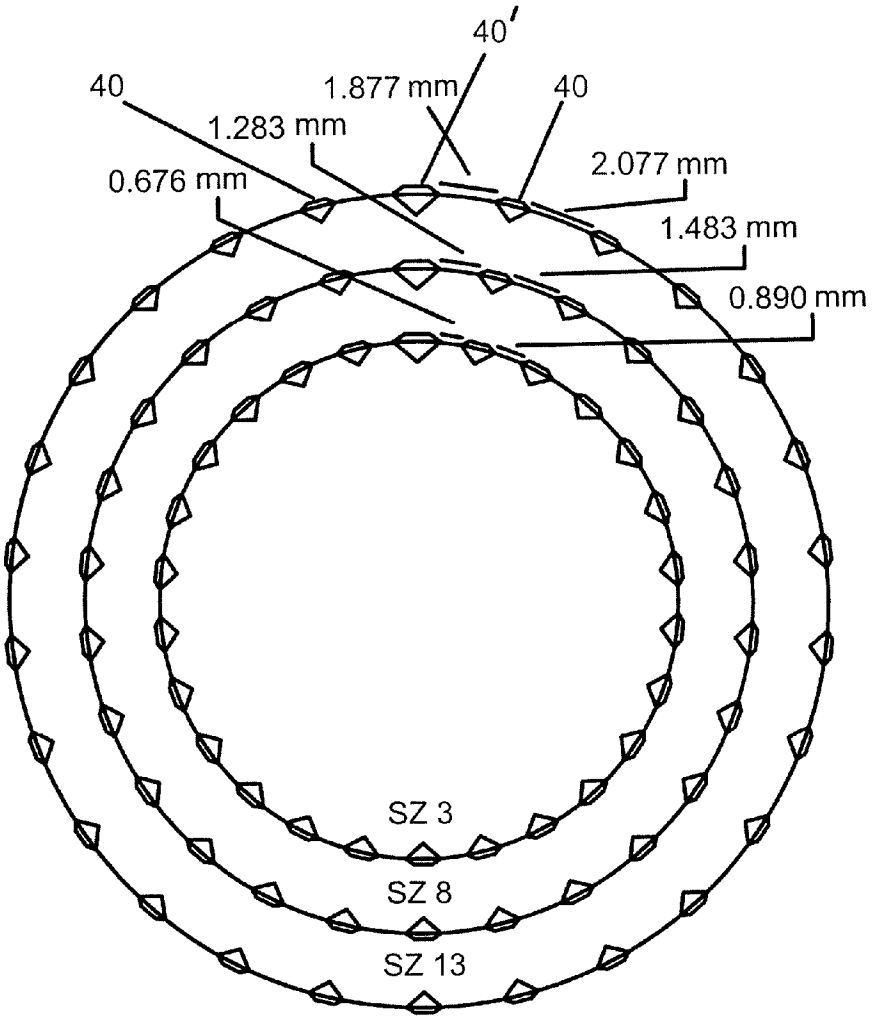

FIGS. 11 and 12 show locations and spacing for 26 gemstones, including one primary gemstone 40' and 25 secondary gemstones 40, for ring sizes 3, 8, and 13. In FIG. 11, all gemstones 40 and 40' are set 2.061 mm, 2.656 mm, and 3.251 mm apart when measured from a center point of gemstone 40 or 40' for sizes 3, 8, and 13, respectively. FIG. 12 shows an edge to edge gemstone spacing for sizes 3, 8, and 12. In FIG. 12, for size 3, primary gemstone 40' may be set 0.676 mm to adjacent secondary gemstones 40, and secondary gemstones 40 may be set 0.890 mm apart from one another. In FIG. 12, for size 8, primary gemstone 40' may be set 1.283 mm to adjacent secondary gemstones 40, and secondary gemstones 40 may be set 1.483 mm apart from one another. In FIG. 12, for size 13, primary gemstone 40' may be set 1.877 mm to adjacent secondary gemstones 40, and secondary gemstones 40 may be set 2.077 mm apart from one another.

Numerous additional modifications and variations of the present disclosure are possible in view of the above teachings. It is therefore to be understood that within the scope of the appended claims, the present disclosure may be practiced other than as specifically described herein.

The invention claimed is:

1. A method for determining locations of markings for the proportional placement of gemstones on portions of outer surfaces of ring shanks of varying finger sizes, where the markings identify center points for the placement of gemstones, where the shank includes one or more marking areas, where the gemstones are of one or more sizes, the method comprising the steps of:

a) receiving ring information including a ring width, a ring thickness and a finger size that define an outer shank circumference, and a predetermined minimum space between markings;

b) receiving gemstone information including a quantity of gemstone markings and a number of gemstone sizes;

c) determining an available gemstone marking area based on the outer shank circumference;

d) determining a number of spaces between markings based on the quantity of gemstone markings, the number of gemstone sizes, the outer shank circumference;

e) determining that the number of gemstone sizes is one or two;

f) determining, if the number of gemstone sizes is one, a gemstone size based on a difference between the available gemstone marking area and a product of the number of spaces between markings and the predetermined minimum space between markings, where the gemstone size allows at least 0.1 mm between girdles of adjacent gemstones, and, for ring shanks of 2 mm through 3 mm width, the gemstone size allows at least 0.4 mm from gemstone girdle to an edge of the ring shank;

g) determining, if the number of gemstone sizes is two, a larger gemstone size and a smaller gemstone size based on one or more of the following: a quantity of smaller gemstones, a quantity of larger gemstones, the predetermined minimum space between markings, the available gemstone marking area, the number of spaces between markings, and a predetermined difference between the larger gemstone size and the smaller gemstone size, wherein:

g1) when the width of the ring shank is 2 mm, the larger gemstone size is at least 0.3 mm larger than the smaller gemstone size, and the larger gemstone size and smaller gemstone size allow at least 0.4 mm from gemstone girdle to the edge of the ring shank;

g2) when the width of the ring shank is 3 mm or greater, and the finger size is 4 through 6.5, the larger gemstone size is at most 1.8 mm and is 0.3 mm larger than the smaller gemstone size, which is at most 1.5 mm;

g3) when the width of the ring shank is 3 mm or greater, and the finger size is 7, the larger gemstone size is at most 1.9 mm and is 0.4 mm larger than the smaller gemstone size, which is at most 1.5 mm;

g4) when the width of the ring shank is 3 mm or greater, and the finger size is 7.5 or greater, the larger gemstone size is 0.3 mm larger than the smaller gemstone size when the smaller gemstone size is 1.5 mm or less, and the larger gemstone size is 0.4 mm larger than the smaller gemstone size when the smaller gemstone size is 1.6 mm or greater;

h) determining locations for markings within the one or more marking areas along the outer surface of the shank based on the quantity of gemstone markings, the determined gemstone sizes, the outer shank circumference;

i) outputting the locations for markings; and j) creating a casting of the ring shank, the casting including the markings according to the locations.

2. The method of claim 1, wherein each marking identifies a center of a platform along the outer surface of the ring shank.

3. The method of claim 1, wherein the markings are symmetrically spaced along the outer surface of the ring shank.

4. The method of claim 1, further comprising the step of k) setting gemstones in the outer surface of the ring shank at the locations.

5. The method of claim 1, further comprising the step of k) setting gemstones in the outer surface of the shank at the marking locations such that a table of the gemstone is substantially flush with the outer surface of the shank.

6. The method of claim 1, wherein the ring is a band.

7. A method for determining locations of platforms for proportional placement of gemstones on portions of outer surfaces of ring shanks of varying finger sizes, where the platforms identify center points for the placement of gemstones, where the shank includes one or more platform areas, where the shank includes one or more non-platform areas, and where the gemstones are of one or more sizes, the method comprising the steps of:

a) receiving ring information including a ring width, a ring thickness and a finger size that define an outer shank circumference, a number of non-platform areas, a size that each non-platform area may not be less than, and a predetermined minimum space between platforms;

b) receiving gemstone information including a quantity of platforms and a number of gemstone sizes;

c) determining an available platform area based on the outer shank circumference, the number of non-platform areas, and the size that each non-platform area may not be less than;

d) determining a number of spaces between platforms based on the quantity of platforms, the number of gemstone sizes, the outer shank circumference, the number of non-platform areas, and the size that each non-platform area may not be less than;

e) determining that the number of gemstone sizes is one or two;

f) determining, if the number of gemstone sizes is one, a gemstone size based on a difference between the available platform area and a product of the number of spaces between platforms and the predetermined minimum space between platforms, where the gemstone size allows at least 0.1 mm between girdles of adjacent gemstones, and, for ring shanks of 2 mm through 3 mm width, the gemstone size allows at least 0.4 mm from gemstone girdle to an edge of the ring shank;

g) determining, if the number of gemstone sizes is two, a larger gemstone size and a smaller gemstone size based on one or more of the following: a quantity of smaller gemstones, a quantity of larger gemstones, the predetermined minimum space between platforms, the available platform area, the number of spaces between platforms, and a predetermined difference between the larger gemstone size and the smaller gemstone size, wherein:

g1) when the width of the ring shank is 2 mm, the larger gemstone size is at least 0.3 mm larger than the smaller gemstone size, and the larger gemstone size and smaller gemstone size allow at least 0.4 mm from gemstone girdle to the edge of the ring shank;

g2) when the width of the ring shank is 3 mm or greater, and the finger size is 4 through 6.5, the larger gemstone size is at most 1.8 mm and is 0.3 mm larger than the smaller gemstone size, which is at most 1.5 mm;

g3) when the width of the ring shank is 3 mm or greater, and the finger size is 7, the larger gemstone size is at most 1.9 mm and is 0.4 mm larger than the smaller gemstone size, which is at most 1.5 mm;

g4) when the width of the ring shank is 3 mm or greater, and the finger size is 7.5 or greater, the larger gemstone size is 0.3 mm larger than the smaller gemstone size when the smaller gemstone size is 1.5 mm or less, and the larger gemstone size is 0.4 mm larger than the smaller gemstone size when the smaller gemstone size is 1.6 mm or greater;

h) determining locations for platforms within the one or more platform areas along the outer surface of the shank based on the quantity of platforms, the determined gemstone sizes, the outer shank circumference, the number of non-platform areas, and the size that each non-platform area may not be less than; and i) creating a casting of the shank, the casting defining the platforms according to the determined locations of the platforms.

8. The method of claim 7, further comprising the step of j) determining the size of the platforms based on one or more dimensions of the ring.

9. The method of claim 7, further comprising: step j) inserting and setting a gemstone into at least one of the platforms.

* * * * *